US006035460A

United States Patent [19]

Borter

[11] Patent Number: 6,035,460

[45] Date of Patent: Mar. 14, 2000

[54] DOUBLE ACTING SHOWER DOOR SYSTEM WITH SPRING-LOADED CONTINUOUS MAGNETIC LATCH WITH EXTENDING DRIP RAIL SYSTEM

[76] Inventor: Clifford Borter, 4922 N. Melrose Ave., Tampa, Fla. 33629

[21] Appl. No.: 08/643,479

[22] Filed: May 6, 1996

[51] Int. Cl.[7] ..... A47K 3/22

[52] U.S. Cl. ..... 4/607; 4/610; 4/605; 4/609

[58] Field of Search ..... 4/607, 609, 610, 4/605, 557, 612; 49/476.1, 475.1, 470, 476, 482

[56] References Cited

U.S. PATENT DOCUMENTS

| | | | |
|---|---|---|---|
| 1,944,440 | 1/1934 | Lehman | 4/607 |
| 3,449,770 | 6/1969 | Casebolt | 4/607 |
| 4,035,957 | 7/1977 | Helax-Roloff | 49/388 |
| 4,375,736 | 3/1983 | Teckchandani | 49/388 |
| 4,897,889 | 2/1990 | Baus | 4/610 |
| 4,981,164 | 1/1991 | Reichel | 4/607 |
| 5,023,965 | 6/1991 | Reichel | 4/607 |
| 5,097,543 | 3/1992 | Oille | 4/607 |
| 5,205,072 | 4/1993 | Eutebach | 9/381 |
| 5,265,309 | 11/1993 | Oille | 16/262 |
| 5,363,616 | 11/1994 | Hernandez | 52/281 |
| 5,448,799 | 9/1995 | Stein | 16/225 |

*Primary Examiner*—David J. Walczak

[57] ABSTRACT

A pivotal door for an entrance of passageway, and particularly for shower and bath enclosures, comprising a plurality of frame members, a panel mounted in adjustable frame members, a channel provided for bottom frame members, and a pair of fixed pivot members retained within one of the adjustable frame members in a socket provided in the shower/bath enclosure frame, the adjustable side frame members being arranged to be affixed at any of a plurality of positions in the shower stall to enable the door to be utilized with enclosures having entrances of different widths.

2 Claims, 9 Drawing Sheets

DOUBLE ACTING SHOWER DOOR SYSTEM WITH SPRING-LOADED CONTINUOUS MAGNETIC LATCH WITH EXTENDING DRIP RAIL SYSTEM

BACKGROUND OF THE INVENTION

The mother of invention is necessity. Many of my past shower door customers have requested shower doors that open inward for many reasons. Whether it was because of a clearance problem, concern for water leakage, or just a convenience to turn on the water to the desired temperature before they enter the shower. I would have to inform my customers about the building code regulations regarding shower doors.

According to the building codes, the shower door must open outward. One reason the door must open out is because of the possibility of water coming out of the shower head at extreme temperatures. The natural reaction of a person being either scalded or shocked by cold water is to escape their environment. The primary escape motion is to push out and panic if the door will not open outward. Another reason the shower door should be capable of opening outward is in case of a sudden or accidental medical emergency: heart attack, fainting, accidental falls, etc. If an individual collapsed in the shower and door only opens inward, the emergency personnel cannot get to the individual without tearing down the door and possibly breaking the glass over the fallen individual. Thus, creating an even more serious and possibly dangerous situation.

My shower door invention meets the demands of both the consumers and the building codes. My shower door has the ability to open both inward and outward of the shower compartment, as well as maintaining a leak proof seal. Thus, maintaining the surrounding area dry. This invention will no doubt change the shower door industry.

(1) Field of the Invention

The present invention relates to doors and particularly shower and bathtub doors, and more particularly refers to doors of the type described which are mounted by means of fixed pivoted members and adjustable wall jambs to permit the door to be mounted at any of a plurality of position depending on the size of the shower/bathtub opening.

(2) Description of Prior Art

Prior art in the shower door industry has not been able to create this 200 degree + movement of the shower door and maintain a leak proof condition when the door is in the closed position. This revolutionary concept can also be produced as a kit that can be applied to existing shower units because of its great flexibility and its great adjustability. Conventional bathtub and shower doors are supported by means of slides or rollers mounted at the top edge of the doors and guided in a track or slot, or hinged along a side door member to control door movements. After extended periods of time, these guides fail or become difficult to use. The top guide rails often cause head injuries to individuals entering the shower. My invention has done away with the top guide rail, and involves new concepts never before used in the shower door industry. If the shower door is installed in an enclosure that restricts outward opening because of a vanity, toilet, or some other obstacle in the area, I have invented a safety feature which also brings it up to code. The top pivot can be lifted up and removed so that the door can be removed without the use of tools.

SUMMARY OF THE INVENTION

It is an object of the present invention to provide a door for the opening of a shower or a bathtub enclosure which is centrally and piviotally mounted.

It is further an object to provide a door of the type described which the pivot is fixed and vertical extrusion jambs are adjustable.

It is still further an object to provide a continuous magnetic latch in which the door will latch from both directions and provide a watertight seal.

It is a further object to provide a door system or kit of the type described which has a great deal of tolerance in the condition of the shower stall walls, and a great flexibility in glass or plastic size of door panel that can be utilized.

It is further an object to provide a door of the type described which has a range of motion in excess of 200 degrees which opens both in and out of the shower/bath compartment.

It is further an object to provide a centralized pivot in the door in which the top pivot can be removed without tools.

It is further an object to provide an extending drip rail system to provide water drainage from shower door when door is in open position and extending rails are concealed when shower door is opened inward.

It is further an object to provide a door with a continuous vinyl seal providing a water proof seal in pivoting action area.

According to the invention, the door structure is provided having adjacent vertical and a lateral frame member and a bottom member provided therein along substantially the entire length thereof, pivot assembly remains fixed and the adjustable vertical frame members are adjusted to the door to create a watertight pivoting door system.

DESCRIPTION OF THE PREFERRED EMBODIMENTS

Figure 1:
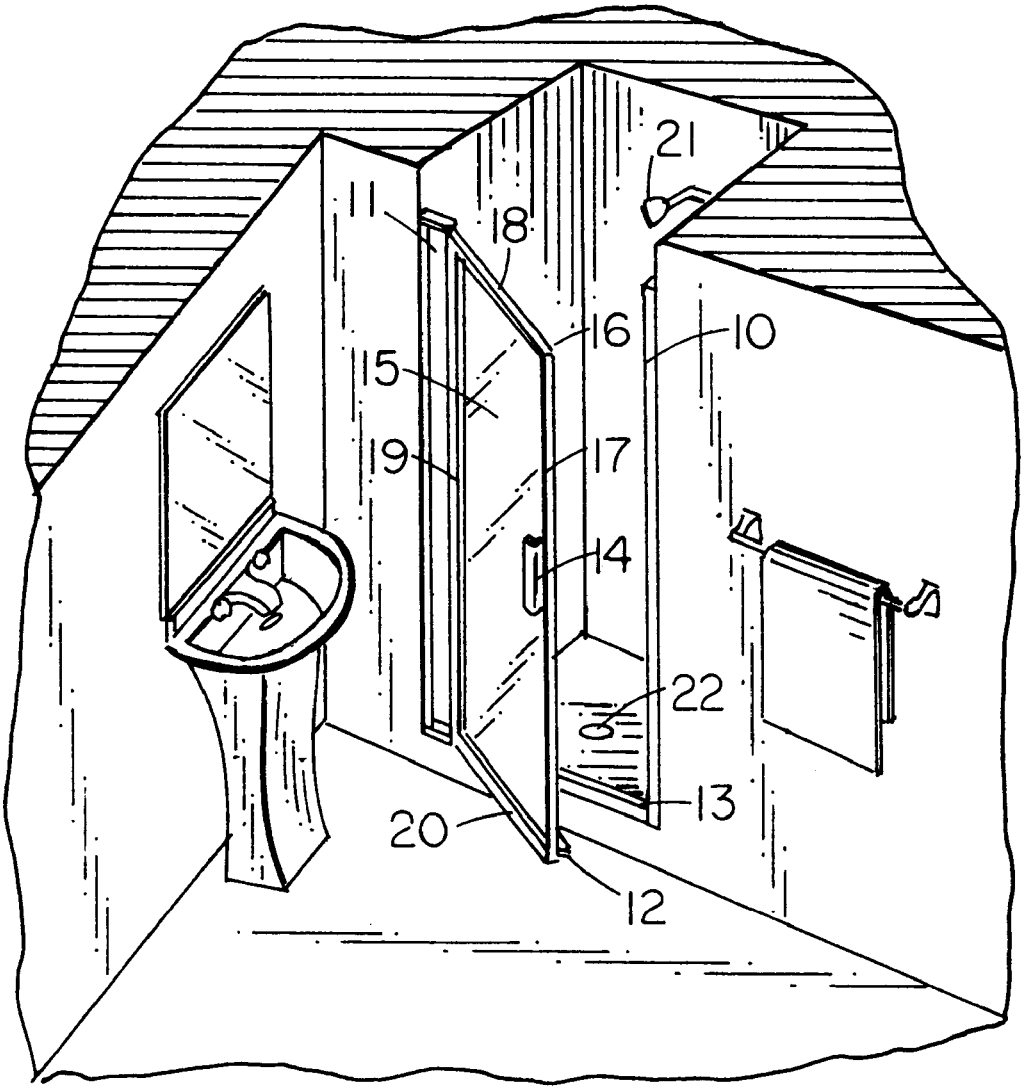
FIG. 1. is a perspective view of a shower stall having a door according to the invention mounted therein.
Figure 2:
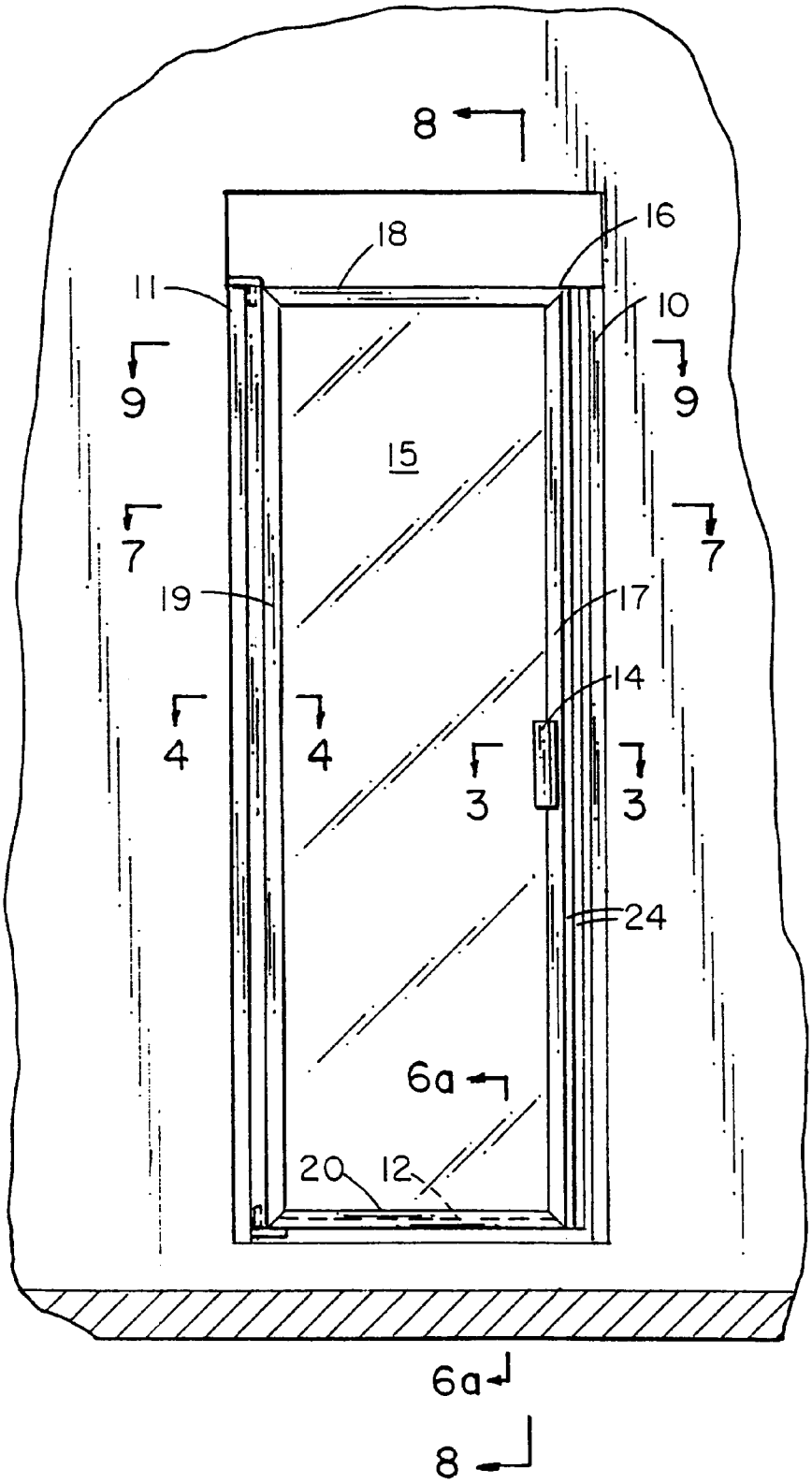
FIG. 2. is an elevational view of the structure shown in FIG. 1.

Referring to FIGS. 1–4, a shower stall having a pivotal shower door according to the invention is shown and comprises a shower enclosure frame comprising of wall jams 10 and 11 and expandable interlocking jambs on both sides of the door 16 and a seal is mounted on the shower base 13. The expandable interlocking jambs are formed on the latching side of the door 16 by jamb members 25, 26, 27 in FIG. 3. The expandable interlocking jamb on the other end of the door 16 is the pivoting side consisting of jamb member 27 and 42.

A door 16 is mounted in the enclosure frame and comprises of an upper door frame member 18, side frame members 19 and 17, and lower door frame member 20. A panel 15 of tempered or laminated glass or a plastic sheet is mounted on the door frame members.

Figure 3:
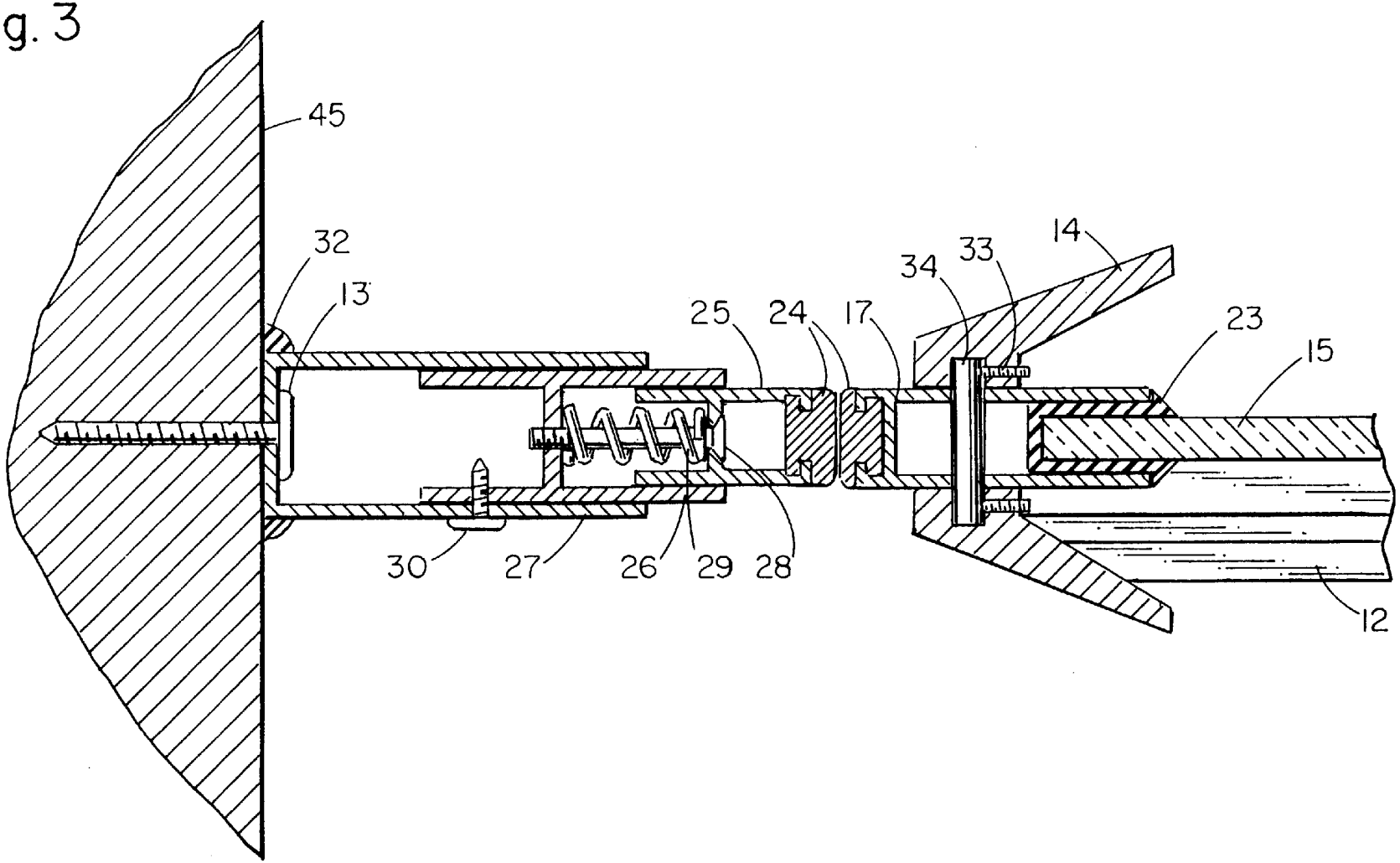
FIG. 3. is a cross-sectional view taken at the line 3—3 of FIG. 2, looking in the direction of the arrows.

Referring more particularly to FIG. 3, a portion of the wall jamb 10 and side frame member 17 are shown. The expandable interlocking jamb 10 is comprised of expandable jamb members 25, 26, 27. The side frame member 10 is provided with a spring loaded magnet-retaining socket 25 having a continuous magnet 24 retained therein. The side frame member 17 is also provided with a continuous magnetic retaining socket on the end of the side frame member having a magnet 24 retained therein. An edge of the glass or plastic panel is mounted in the side frame members 17, 18, 19, and 20 by means of a sealing gasket 23. Handles 14 are provided for the opening and closing of the door assembly 16. Handles 14 are held in place by non-corrosive rods 34 at the top and bottom sections. Non-corrosive set screws 33 anchor handles 14 to the non-corrosive rods 34.

The unique spring-loaded continuous magnetic latch is held in place by four non-corrosive springs 29 pushing out against four non-corrosive flat headed bolts 28 which are threaded into adjustable interlocking frame member 26 and floating on frame member 25. As pressure is applied to continuous magnet 24, frame member 25 freely pushes against non-corrosive springs 29 inwardly and is guided by non-corrosive bolts 28 in a linear motion. The reaction to this pressure is a tension created by the non-corrosive springs 29 in the opposite direction creating a latch from the pressure and a latch from the magnetic attraction making a water proof seal between door assembly 16 and latch assembly 10 FIG. 2.

Figure 4:
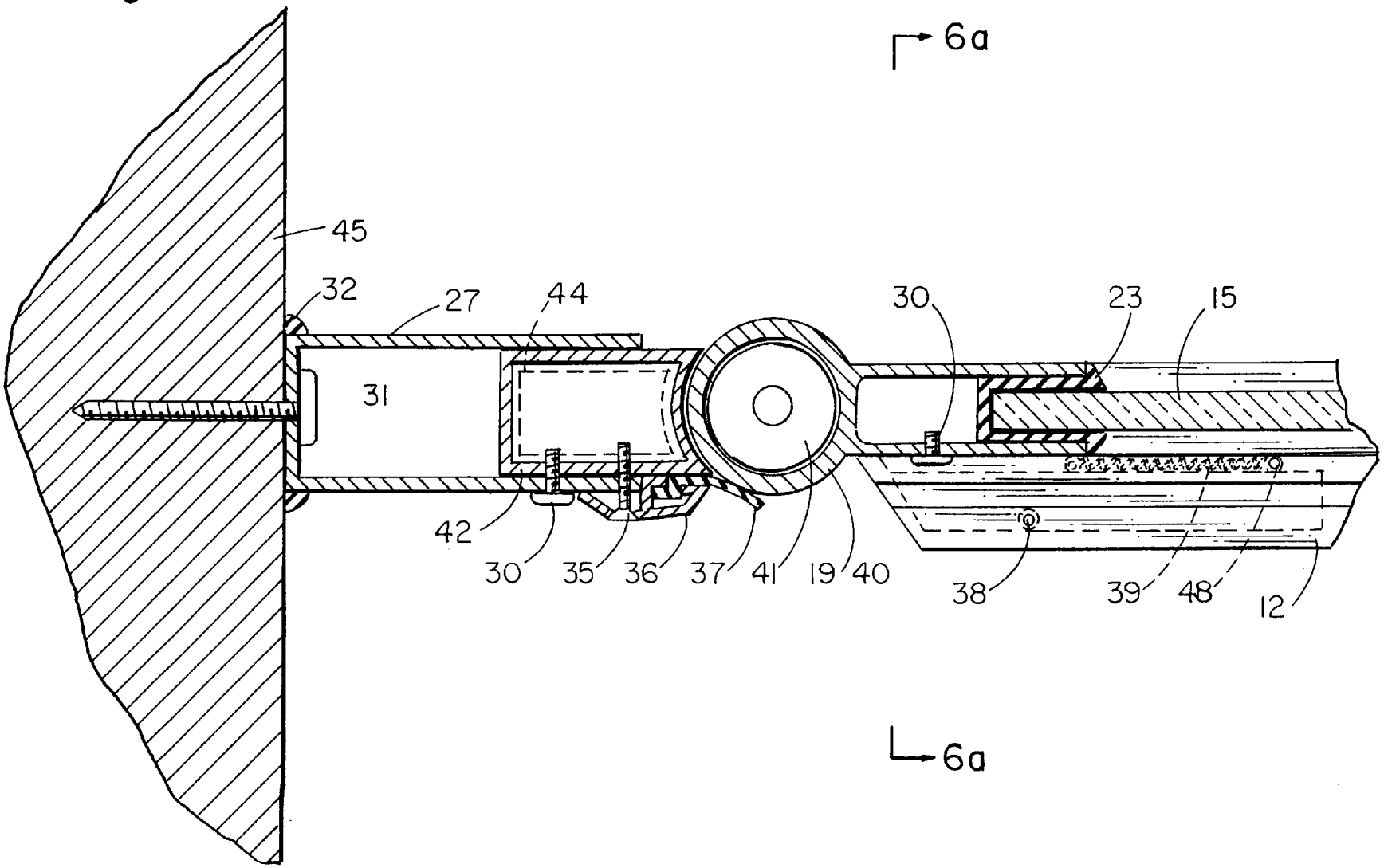
FIG. 4. is a cross-sectional view taken at the line 4—4 of FIG. 2, looking in the direction of the arrows.

Referring to FIG. 4, the side frame member 19 is shown having one edge of the glass or plastic panel 15 mounted therein by means of a sealing gasket 23. Also shown is drip rail 12 attached to the bottom end of side frame member 19 and to the bottom frame member 20. Concealed under the drip rail 12 is extending rail 40 that extends when the door 16 is opened outward and is extended out by hitting the shower base 13 so that moisture is channeled back into shower compartment when door 16 is opened outward. Extending drip rail 40 returns to its original position by a non-corrosive spring 39 and remains out of the way when door 16 is opened inward.

Referring to FIG. 4, frame member 19 is pivoted on quarter/radius socket side framing member 42 which is adjustable to bring door assembly 16 plumb by means of three non-corrosive screws 30 fastened on the shower stall side into side wall framing member 27. A clear vinyl weather strip 37 is held against side frame member 19 by vinyl/retaining socket extrusion 36 that runs full length of side frame members 42 and 27. The vinyl retaining socket extrusion 36 is held in place by four non-corrosive flat-headed screws 35. The vinyl retaining socket extrusion 36 can be placed on side wall framing member 27 or on quarter/radius socket side framing member 42 depending on how much adjustment is needed to keep door 16 plumb. The side wall framing member 27 is anchored to shower wall 45 by non corrosive pan head screw 31.

Figure 5A:
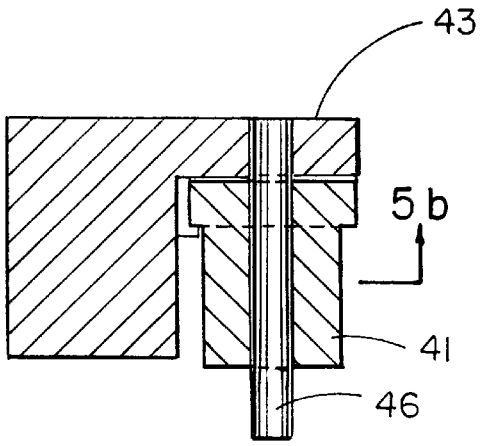
FIG. 5*a*. is a side view of the top pivot assembly.
Figure 5B:
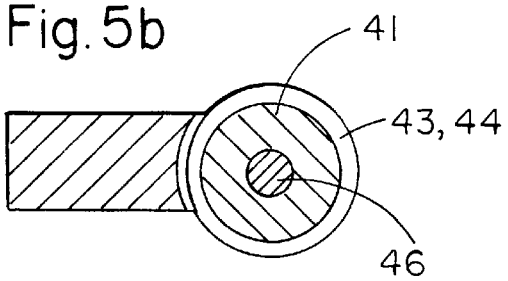
FIG. 5*b*. is an elevational view of top and bottom pivots.
Figure 5C:
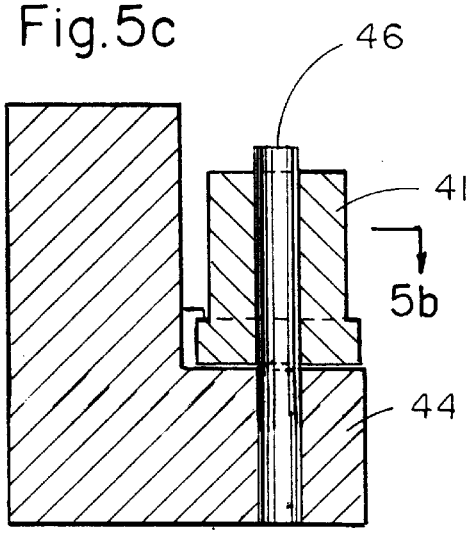
FIG. 5*c*. is a side view of the bottom pivot assembly.
Figure 5D:
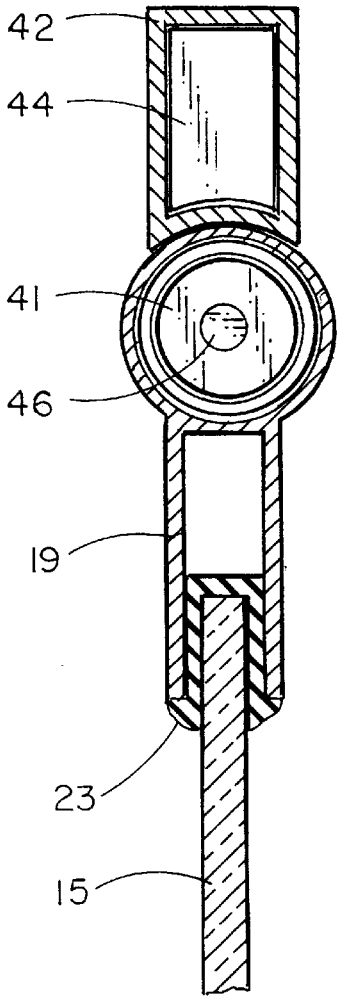
FIG. 5*d*. is a cross-sectional view of the bottom pivot and the mounting in door and frame members.

Referring to FIGS. 5*a*.–5*d*. the top pivot 43 and bottom pivot 44 are shown. The top pivot 43 is designed to slide into side frame door member 19 with Tivar 1000 UHMW bushing 41 and quarter/radius socket side framing member 42 at the same time and is designed not to be fastened in case of emergency entrapment or for cleaning purposes of the door 16. The bottom pivot 44 was also designed to slide into side framing door member 19 with a Tivar 1000 UHMW bushing 41 and quarter/radius socket side framing member 42 but is designed with a higher base to permit proper clearance for door 16's pivoting action. Bottom pivot 44 rests on the shower base 13 and cannot be removed unless quarter/radius socket side frame member 42 is removed from side wall framing member 27. Both top pivot 43 and bottom pivot 44 have a stainless steel pin 46 press fitted into their base sections.

Stainless steel pin 46 fits into Tivar 1000 UHMW bushing 41 which fits into side frame door member 19 to allow pivoting action to occur with a low coefficient of friction. Bushing Tivar 1000 UHMW 41 was designed large to reduce strain on the bushing. A cross-sectional view of both top 43 and bottom 44 pivots would look identical. FIGS. 5*a*–5*d*, also shows placement of top pivot 43 and bottom pivot 44 on top and bottom respectively of quarter/radius frame side member 42 and side frame door member 19 to form a tightly tolerance door pivot.

Figure 6A:
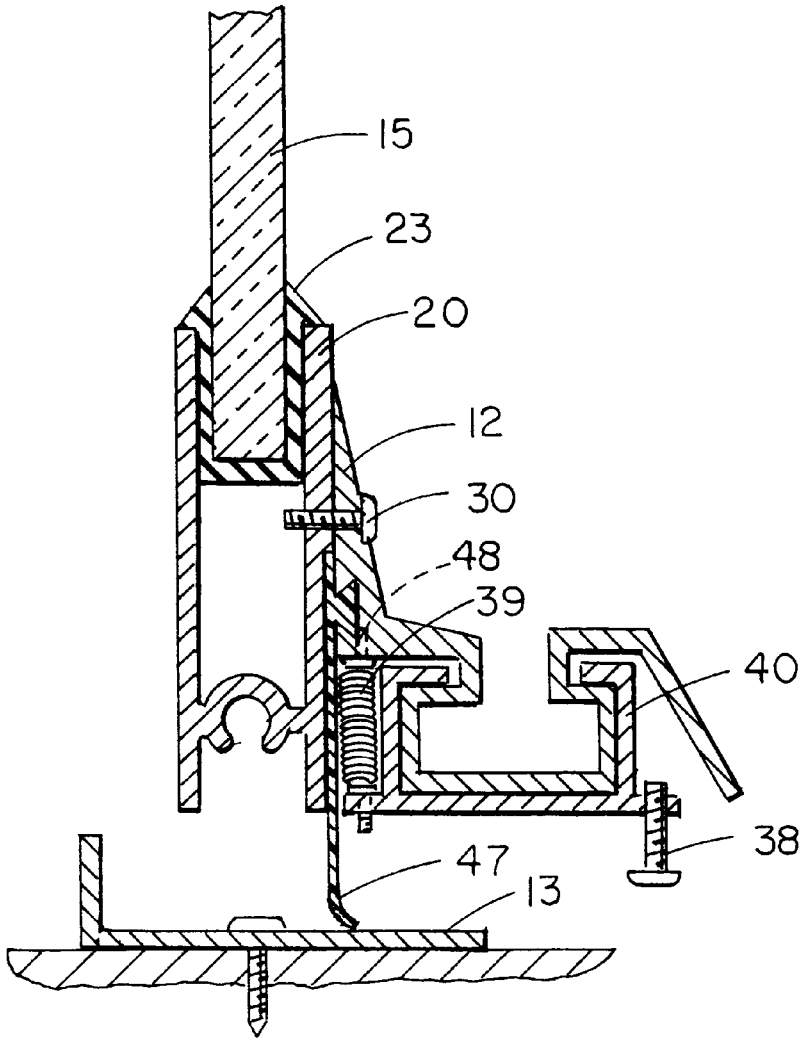
FIG. 6*a*. is a cross-sectional view of the extending drip rail system.
Figure 6B:
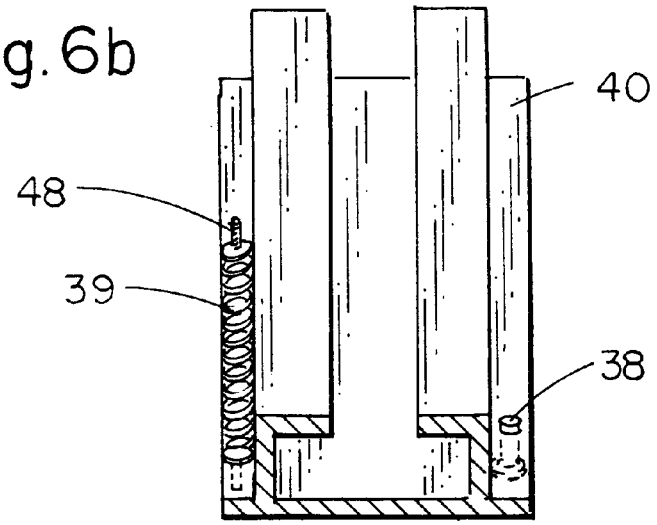
FIG. 6*b*. is an elevational view of extending drip rail extension extrusion.

Referring to FIGS. 6*a* and 6*b* shows a cross-section of bottom frame door member 20 and drip rail 12 with extending drip rail 40 on shower base 13. The extending drip rail 40 is activated by the shower base 13 as the door 16 is pivoted outward and is returned to place by non-corrosive spring 39 to its original position when the door 16 is closed or opened inward and remains out of the way when door 16 is opened into the shower pan area. A vinyl sweep 47 is held vertically by drip rail 12 in its vinyl socket to prevent water from splashing out when shower head 21 is activated while door 16 is latched. Extending drip rail 40 travels along drip rail 12 in a linear motion. Extending drip rail 40 extends only when door assembly 16 is opened outward and is intended to channel back water remaining on door assembly 16 back into shower area as the water falls off of door assembly 16 keeping the bathroom floor dry after the shower is over.

Figure 7:
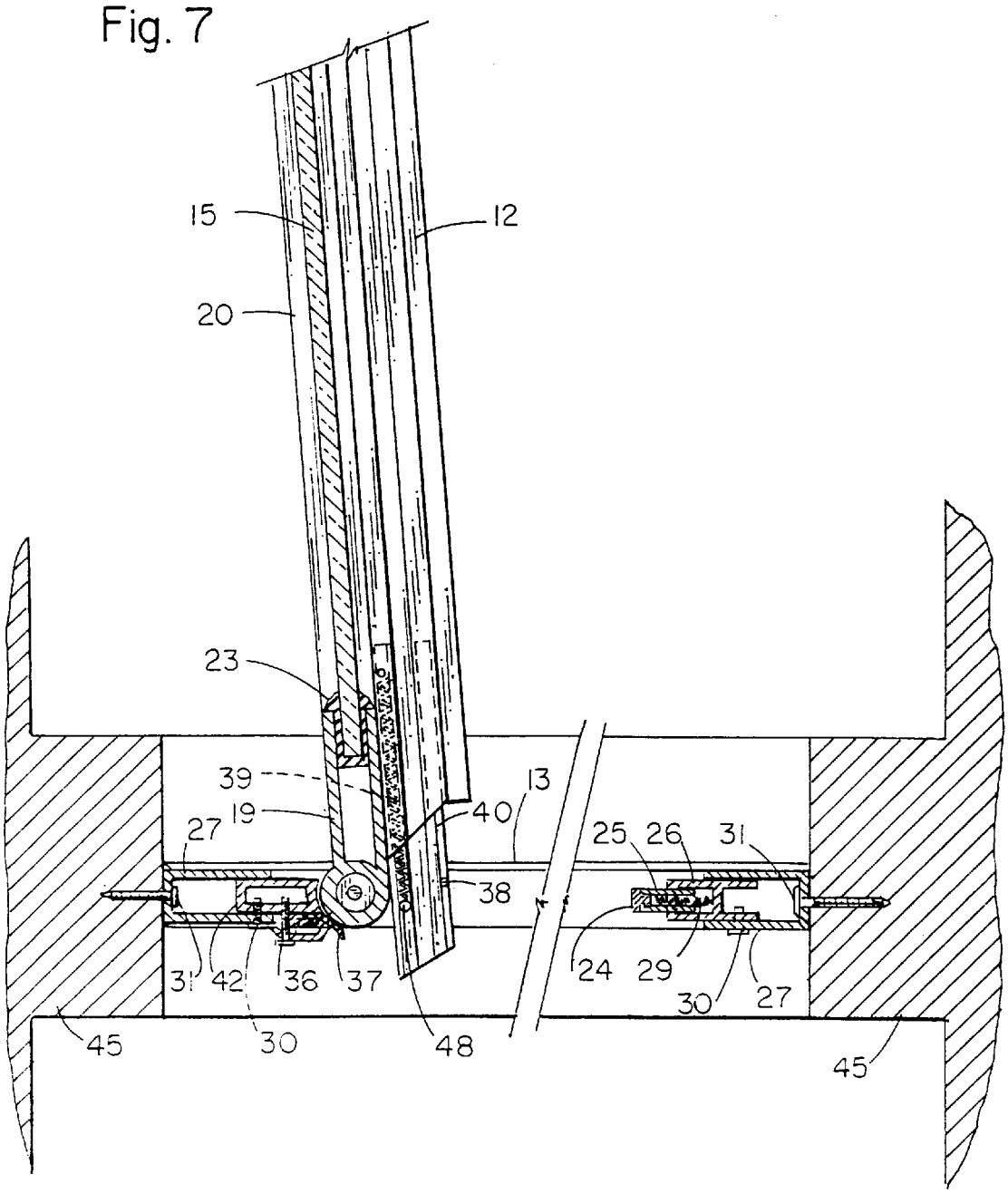
FIG. 7. is a cross-sectional view at the line 7—7 of FIG. 2, looking in the direction of the arrows.

Referring to FIG. 7, shows a cross-sectional view of door assembly 16 opened outwardly and extending drip rail 40 extended into shower area to allow water running off of door assembly 16 into shower pan area while door is held open. The hidden activating bolt 38 is held in place by shower base 13 as door assembly 16 is opened outward forcing extending drip rail 40 outward. Water flows off of door assembly 16 on to drip rail's 12 channel back towards shower area 45 on to extended drip rail 40. Water then flows down into shower area 45 on shower side of the shower base 13 keeping the water inside shower compartment and keeping the surrounding areas dry.

Figure 8:
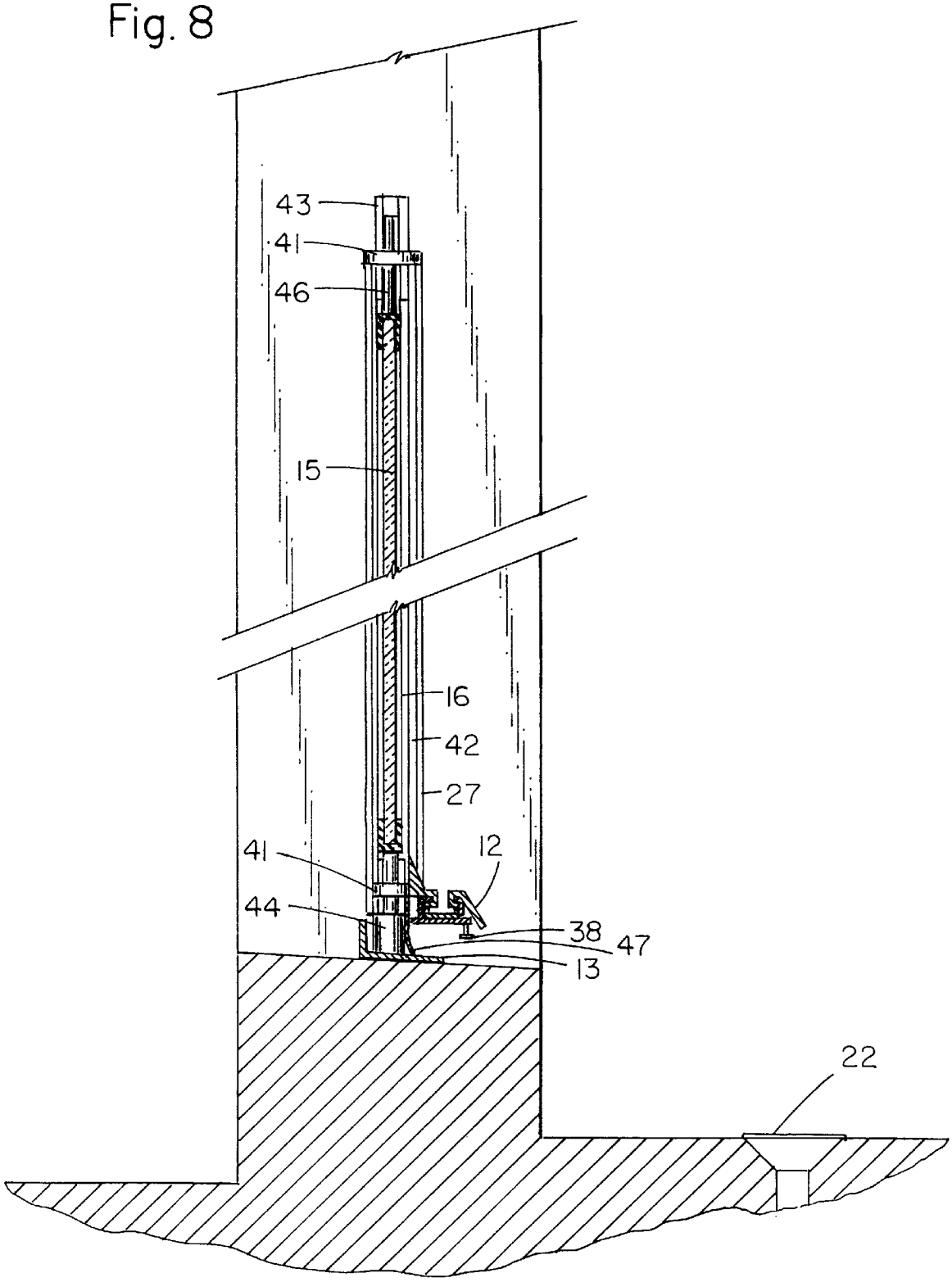
FIG. 8. is a cross-sectional view at the line 8—8 of FIG. 2, looking in the direction of the arrows.

Referring to FIG. 8, shows a cross-sectional view of shower door assembly 16 and placement of drip rail assembly 12 in regards to shower area with drain 22.

Figure 9:
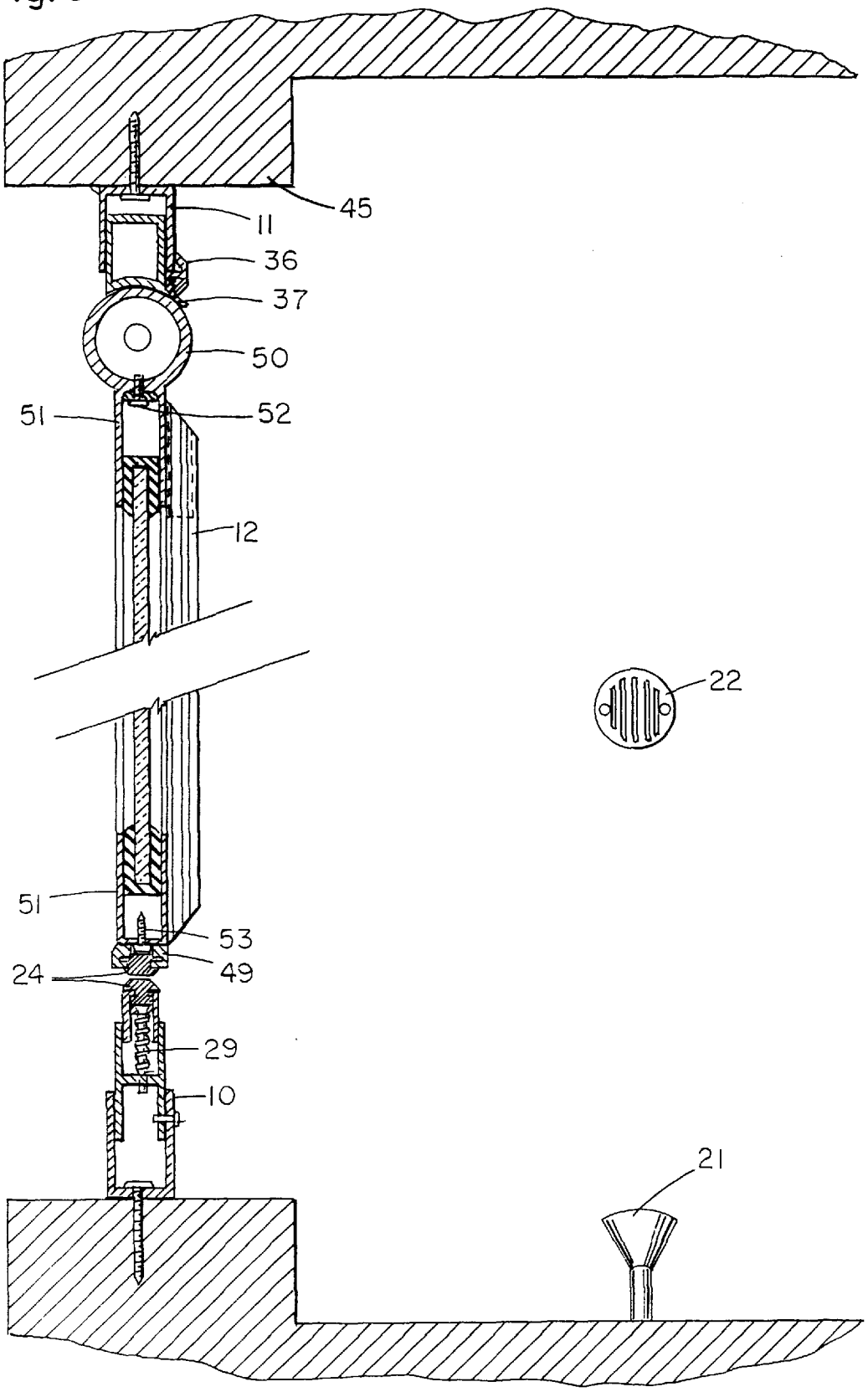
FIG. 9. is a perspective view (cross-sectional) of an existing shower door with kit added.

Referring to FIG. 9, is a cross-section of framing members that would be provided as a kit to consumers who already have an existing shower unit and would like to convert their unit into a double-acting shower door with a continuous magnetic latch and extending drip rail system. The kit would contain many of the same parts as the shower door system. For example, both side wall jamb sections 10 and 11 FIG. 2, would be the same, as would the drip rail system 12.

Only two parts supplied in the kit would be substantially different. The first part is a screw applied magnetic socket extrusion 49 capable of holding magnet strip 24 along the full length of the (customer's) door frame. The magnetic strip 24 would hide the flat head screws 53 used to attach the magnetic socket extrusion 49 to the customer's door frame. The second part is a hollowed circular extrusion 50 with the same inside and outside circumference as pivoting door frame member 19 and a flat surface milled on extruded to join with customer's existing door frame 51. The hollowed circular extrusion 50 would use the same hardware as he pivoting door frame member 19 and would be joined to the customer's door frame 51 by screws applied through the back of the customer's door frame member into hollowed circular extrusion 50 in approximately four places with pan headed screws 52 to support customer's door 51 to hollowed circular extrusion 50 which would then look and act like pivoting door frame member 19. The other parts would function as in the double acting shower door system with spring-loaded continuous magnetic latch with extending drip rail system.

REFERANCES CITED

U.S. PATENT DOCUMENTS:

| | | | |
|---|---|---|---|
| 4,035,957 | 6/1977 | Helax-Roloff | 49/388 |
| 4,375,736 | 3/1983 | Teckchandani | 49/388, 90 |
| 5,097,543 | 3/1992 | Oille | 44/607, 4/612 |
| 5,205,072 | 4/1993 | Eutebach | L9/381, 16/235 |
| 5,265,309 | 11/1993 | Oille | 16/262, 16/379 |
| 5,363,616 | 11/1994 | Hernandez | 52/281, 52/71 |
| 5,448,799 | 9/1995 | Stein | 16/225, 224, 223, 268 |

What is claimed is:

1. A spring loaded latch mechanism for a shower door adapted to be mounted on a wall of a shower stall comprising:

a shower door having a side frame member extending along an edge thereof, said side frame member having a first retaining socket extending along the length thereof;

a first magnet mounted in said first retaining socket;

a side wall frame member adapted to be secured to the wall of the shower stall;

an interlocking frame member secured to said side wall frame member;

a second retaining socket movably secured within said interlocking frame member by a plurality of movable mounting means, each said movable mounting means comprising a bolt fastened to said interlocking frame member wherein said second retaining socket is slidably mounted on said bolt and a spring mounted around said bolt and between said second retaining socket and said interlocking frame member to thereby bias said second retaining socket away from said interlocking frame member and;

a second magnet mounted in said second retaining socket whereby upon closing of said shower door, said first magnet contacts said second magnet and said springs apply a pressure to said second magnet to thereby form a waterproof seal between said shower door and the wall of the shower stall.

2. An extendable drip rail for a shower door adapted to be mounted on a wall of a shower stall wherein the shower stall includes a shower base adjacent a lower edge of the shower door when the shower door is closed comprising:

a drip rail adapted to be mounted along a lower edge of the shower door;

an extendable drip rail slidably mounted to said drip rail in a first position beneath said drip rail;

a spring mounted between said drip rail and said extendable drip rail and;

an activating bolt secured to said extendable drip rail wherein when the shower door is open outwardly from the shower stall, said activating bolt is adapted to contact the shower base and thereby, upon further movement of the shower door, said contact between said activating bolt and the shower base causes said extendable drip rail to slide out from beneath said drip rail to a second position to thereby extend the drip rail such that water from the shower door runs from the drip rail, onto the extendable drip rail and into the shower stall and, upon closing of the shower door, said spring biases said extendable drip rail such that said extendable drip rail returns to said first position beneath said drip rail.

* * * * *